US010519646B2

(12) United States Patent
Pleasants

(10) Patent No.: US 10,519,646 B2
(45) Date of Patent: Dec. 31, 2019

(54) CABLE FEED MECHANISM FOR A DRAIN CLEANER

(71) Applicant: TTI (MACAO COMMERCIAL OFFSHORE) LIMITED, Macau (MO)

(72) Inventor: Parke Pleasants, Overland Park, KS (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 298 days.

(21) Appl. No.: 15/795,696

(22) Filed: Oct. 27, 2017

(65) Prior Publication Data

US 2019/0127964 A1 May 2, 2019

(51) Int. Cl.

| | |
|---|---|
| ***B08B 9/045*** | (2006.01) |
| ***E03C 1/302*** | (2006.01) |
| ***E03F 9/00*** | (2006.01) |

(52) U.S. Cl.

CPC ..... *E03F 9/005* (2013.01); *B08B 9/045* (2013.01); *E03C 1/302* (2013.01)

(58) Field of Classification Search

CPC ..... B08B 9/045; E03C 1/302; E03F 9/005
See application file for complete search history.

(56) References Cited

U.S. PATENT DOCUMENTS

| | | | | |
|---|---|---|---|---|
| 2,102,917 | A * | 12/1937 | Rolland | E03F 9/005 15/104.33 |
| 2,661,489 | A | 12/1953 | Rudolph et al. | |
| 3,298,666 | A | 1/1967 | Prange | |
| 3,691,583 | A | 9/1972 | Silverman et al. | |
| 3,928,885 | A * | 12/1975 | Peterson | B08B 9/045 15/104.33 |
| 4,218,802 | A | 8/1980 | Babb et al. | |
| 4,580,306 | A | 4/1986 | Irwin | |
| 4,686,732 | A | 8/1987 | Irwin | |

(Continued)

FOREIGN PATENT DOCUMENTS

| | | |
|---|---|---|
| EP | 2277634 | 1/2011 |
| EP | 2371462 | 5/2014 |

(Continued)

OTHER PUBLICATIONS

Super-Vee, "DrainBrain," <http://www.drainbrain.com/literature/pdf/supervee.pdf> available as early as Jul. 6, 2016 (2 pages).

(Continued)

*Primary Examiner* — Randall E Chin
(74) *Attorney, Agent, or Firm* — Michael Best & Friedrich LLP

(57) ABSTRACT

A drain cleaner includes a rotatable drum and a cable having a first portion housed within the drum and a second portion extending outwardly of the drum along a cable axis. The cable is rotatable about the cable axis. The drain cleaner also includes a cable feed mechanism for feeding the cable out of the rotatable drum in an axial direction along the cable axis. The cable feed mechanism includes a plurality of feed members selectively engagable with the cable, and a drive gear surrounding the plurality of feed members. The drive gear is engaged with the plurality of feed members. Rotation of the drive gear moves the plurality of feed members into engagement with the cable.

20 Claims, 15 Drawing Sheets

(56) References Cited

U.S. PATENT DOCUMENTS

| | | | |
|---|---|---|---|
| 4,956,889 | A | 9/1990 | Kirk |
| 5,029,356 | A | 7/1991 | Silverman et al. |
| 5,031,263 | A | 7/1991 | Babb et al. |
| 5,031,276 | A | 7/1991 | Babb et al. |
| 5,640,736 | A | 6/1997 | Salecker |
| 5,901,401 | A | 5/1999 | Rutkowski et al. |
| 6,009,588 | A | 1/2000 | Rutkowski |
| 6,158,076 | A | 12/2000 | Rutkowski et al. |
| 6,243,905 | B1 | 6/2001 | Rutkowski |
| 6,343,398 | B1 | 2/2002 | Silverman et al. |
| 6,360,397 | B1 | 3/2002 | Babb |
| 6,412,136 | B1 | 7/2002 | Rutkowski |
| 6,470,525 | B1 | 10/2002 | Silverman |
| 6,637,064 | B2 | 10/2003 | Silverman et al. |
| 6,655,228 | B1 | 12/2003 | Margherio et al. |
| 7,478,451 | B2 | 1/2009 | Rutkowski et al. |
| 7,685,669 | B2 | 3/2010 | Rutkowski et al. |
| 8,826,483 | B2 | 9/2014 | Rutkowski et al. |
| 2008/0244816 | A1 | 10/2008 | Babb et al. |
| 2016/0175899 | A1 | 6/2016 | Dunkin et al. |
| 2017/0304879 | A1 | 10/2017 | Hsu |

FOREIGN PATENT DOCUMENTS

| | | | |
|---|---|---|---|
| EP | 3276098 | A2 | 1/2018 |
| WO | 2006112848 | | 10/2006 |

OTHER PUBLICATIONS

European Patent Office Search Report for Application No. 18202399.4 dated Feb. 19, 2019, 8 pages.

* cited by examiner

CABLE FEED MECHANISM FOR A DRAIN CLEANER

FIELD OF INVENTION

The present invention relates to drain cleaners, and specifically, to a feed mechanism of a drain cleaner.

BACKGROUND

Drain cleaners are used to clean dirt and debris out of drains or other conduits that collect debris in locations that are difficult to access. Drain cleaners typically have a cable or snake that is inserted into the drain to collect the debris. Some cables are manually fed into the drain, while others are driven into the drain by a motor.

SUMMARY

In one embodiment, the invention provides a drain cleaner including a rotatable drum and a cable having a first portion housed within the drum and a second portion extending outwardly of the drum along a cable axis. The cable is rotatable about the cable axis. The drain cleaner also includes a cable feed mechanism for feeding the cable out of the rotatable drum in an axial direction along the cable axis. The cable feed mechanism includes a plurality of feed members selectively engagable with the cable, and a drive gear surrounding the plurality of feed members. The drive gear is engaged with the plurality of feed members. Rotation of the drive gear moves the plurality of feed members into engagement with the cable.

In another embodiment, the invention provides a drain cleaner including a rotatable drum and a cable having a first portion housed within the drum and a second portion extending outwardly of the drum along a cable axis. The cable is rotatable about the cable axis. The drain cleaner also includes a cable feed mechanism for feeding the cable in an axial direction along the cable axis. The cable feed mechanism includes a plurality of feed members selectively engagable with the cable. Engagement of the plurality of feed members with the cable feeds the cable along the cable axis. The cable feed mechanism also includes a drive gear concentrically surrounding the plurality of feed members and a collar concentrically surrounding the drive gear. The collar is rotatably fixed relative to the drive gear to change the feed direction by rotation of the drive gear and linearly movable relative to the drive gear to lock and unlock the drive gear from further rotation. Rotation of the collar moves the plurality of feed members into engagement with the cable.

In yet another embodiment, the invention provides a drain cleaner including a rotatable drum and a cable having a first portion housed within the drum and a second portion extending outwardly of the drum along a cable axis. The cable is rotatable about the cable axis. The drain cleaner also includes a plurality of feed members selectively engagable with the cable to feed the cable along the cable axis, and a drive gear surrounding the plurality of feed members. The drive gear is engaged with the plurality of feed members. Rotation of the drive gear rotates the plurality of feed members and moves the plurality of feed members into engagement with the cable. The drain cleaner further inclues a collar extending concentrically around the drive gear. The collar is rotatably fixed relative to the drive gear and is linearly movable relative to the drive gear. The collar includes a protrusion. The drain cleaner also includes a carrier supporting the plurality of feed members and the drive gear. The carrier includes a plurality of slots. Linear movement of the collar relative to the carrier selectively moves that protrusion into engagement with one of the plurality of slots.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
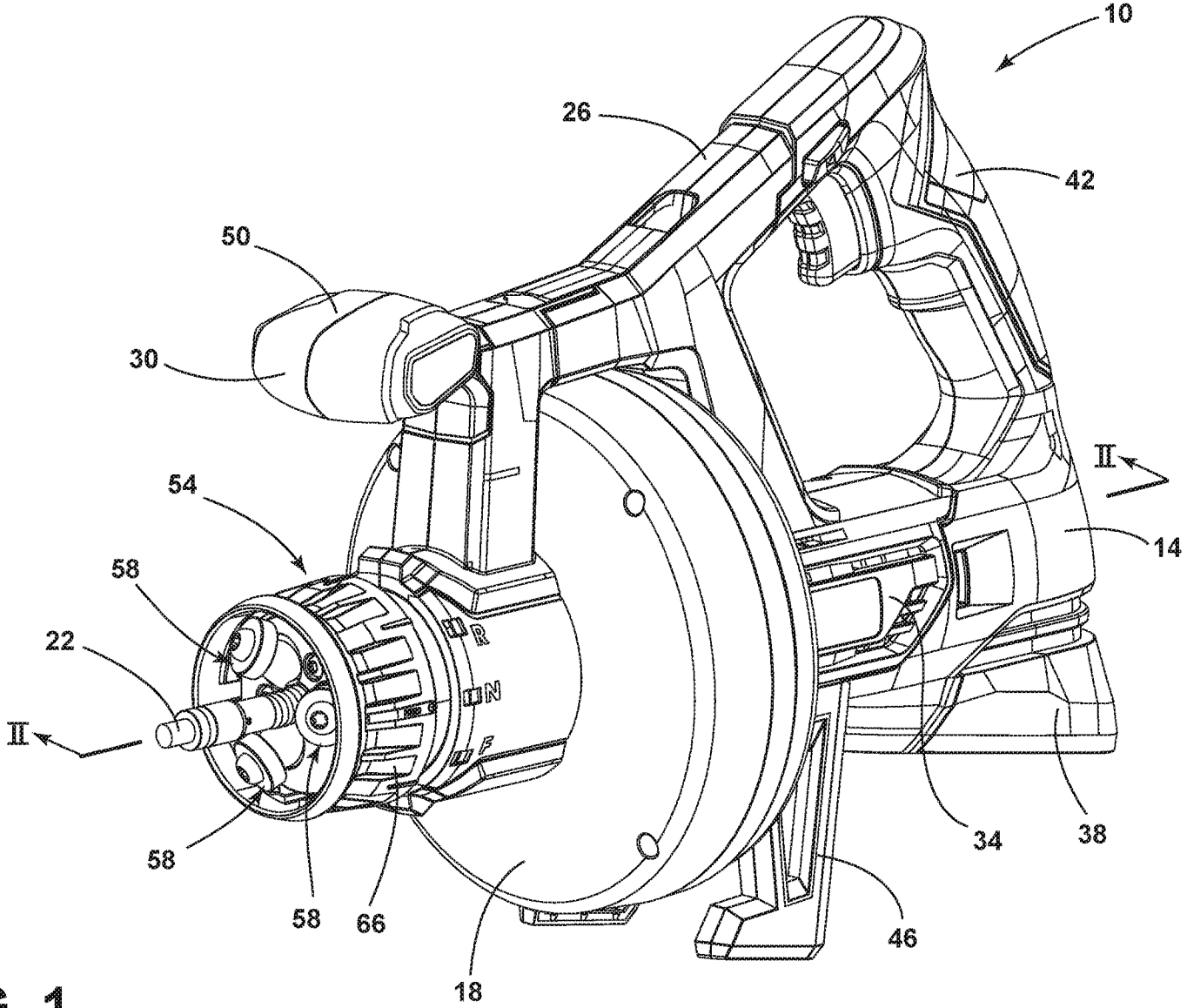
FIG. 1 is a perspective view of a drain cleaner according to one embodiment.
Figure 2:
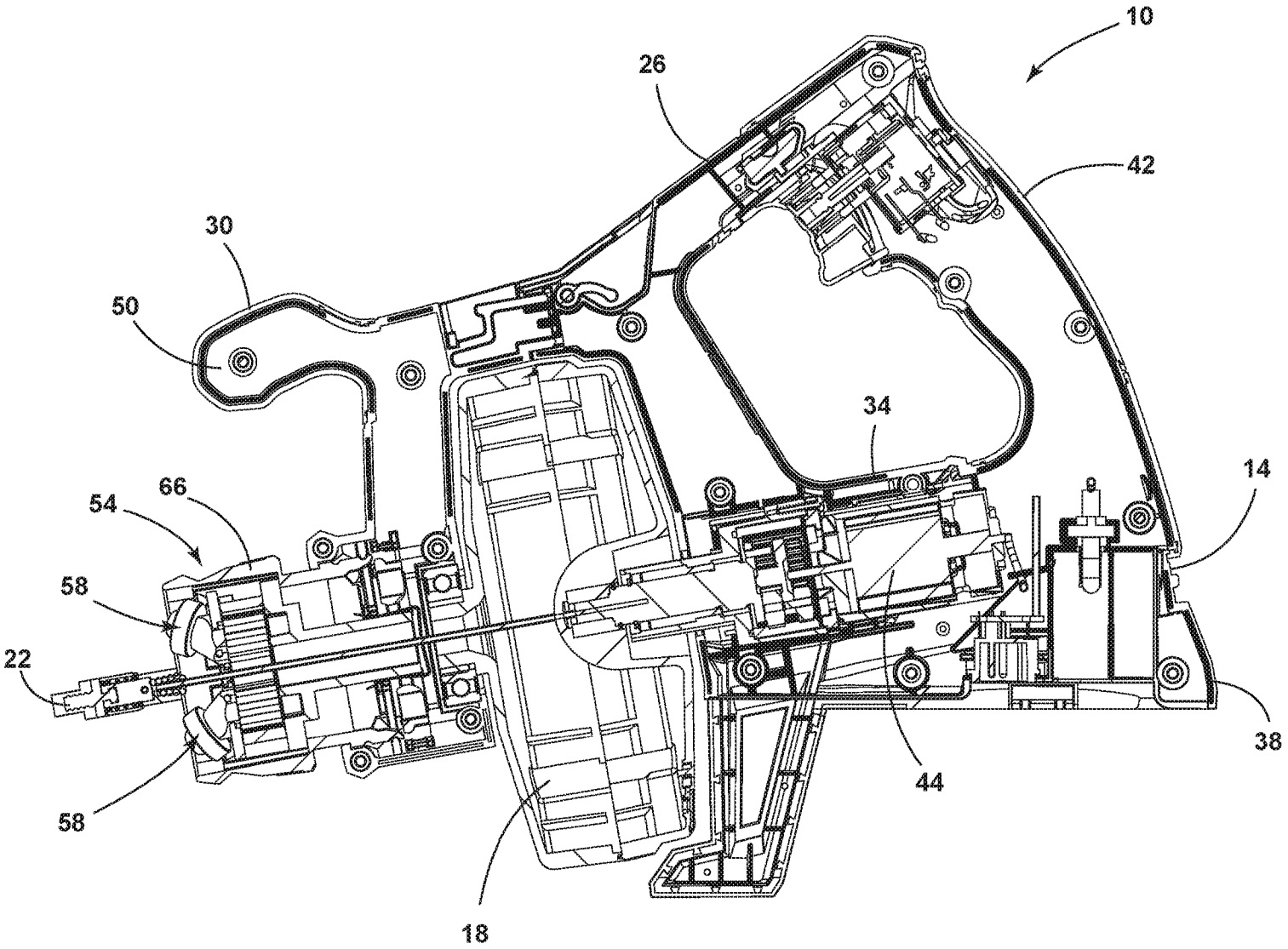
FIG. 2 is a cross-sectional view of the drain cleaner taken along section line II-II of FIG. 1.
Figure 3:
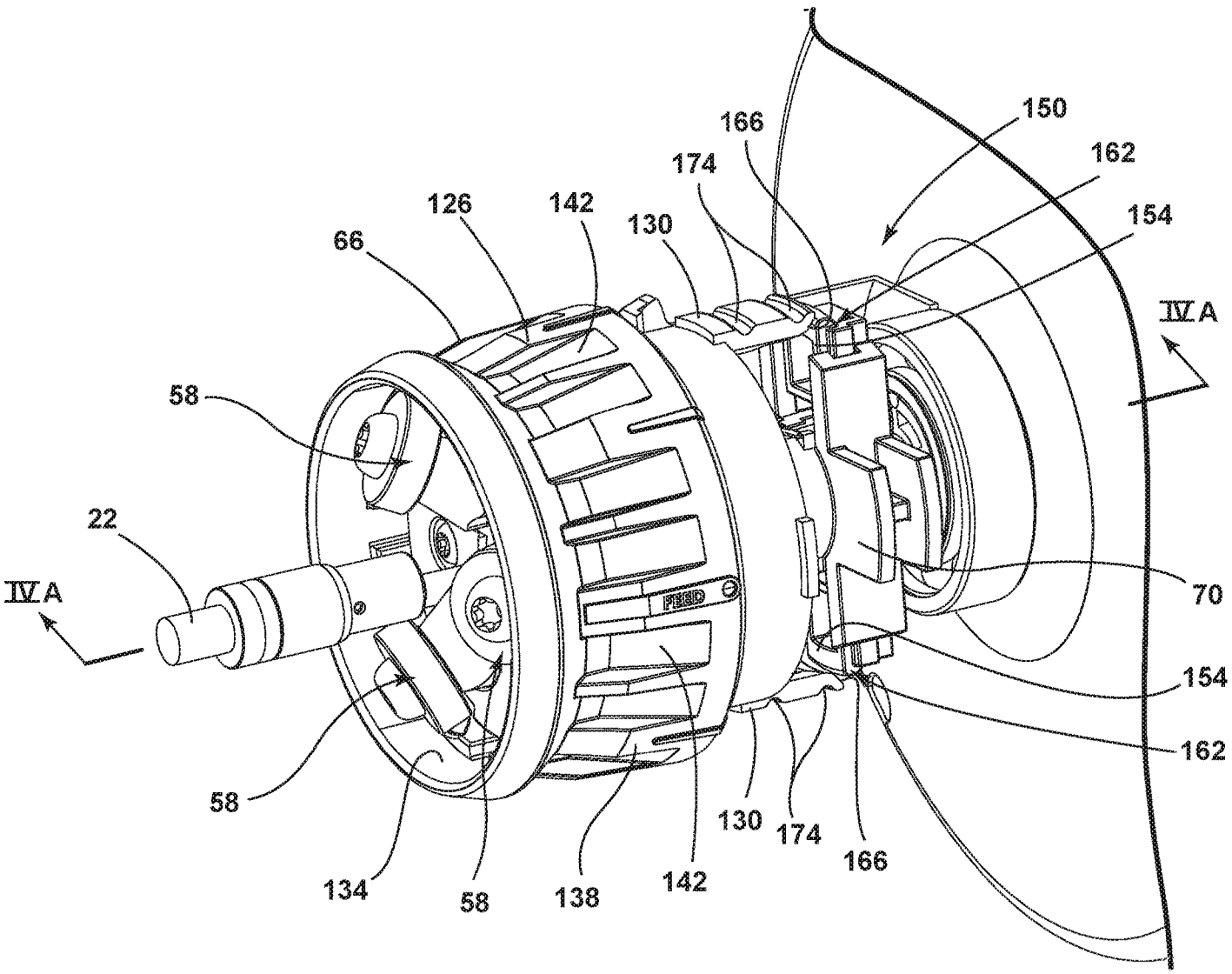
FIG. 3 is an enlarged perspective view of a cable feed mechanism of the drain cleaner of FIG. 1 with a portion of a housing removed.

FIGS. 1 and 2 illustrate a drain cleaner 10 according to one embodiment. The illustrated drain cleaner 10 includes a body 14 and a drum 18 rotatably supported by the body 14. A flexible cable 22 is stored within the drum 18 and extends through a portion of the body 14. More specifically, a first portion of the cable 22 is wound within the drum 18 and a second portion of the cable 22 extends outwardly of the drum 22 in a linear direction along a cable axis 24. The cable 22 is insertable into a drain, or other conduit, for cleaning the drain. Rotation of the drum 18 results in rotation of the cable 22. Specifically, friction between the inner surface of the drum 18 and the cable 22 causes the cable 22 to rotate or spin with the drum 18. Rotation of the cable 22 helps break up and collect debris within the drain. Additionally, in the illustrated embodiment, the cable 22 is helically woundwith a threaded pattern. The threaded pattern of the cable 22 enables the cable 22 to be fed into or out of the drum 18. When the threads of the cable 22 are frictionally engaged in a first direction (e.g., in alignment with the threaded pattern), the cable 22 is fed forwardly out of the drum 18. When the threads of the cable 22 are frictionally engaged in a second direction (e.g., opposing the threaded pattern), the cable 22 is fed in reverse out of the drum 18.

The body 14 includes a first housing 26 and a second housing 30. In the illustrated embodiment, the drum 18 is disposed between the first housing 26 and the second housing 30. The first housing 26 includes a motor compartment 34, a battery receptacle 38, a handle assembly 42, and a stand 46. The motor compartment 34 houses at least a portion of a motor 44 (FIG. 2) and a drive mechanism for rotating the drum 18.

The drum 18 is coupled to the drive mechanism such that rotation of the motor 44 is transmitted to the drum 18 through the drive mechanism. The drive mechanism can include any suitable means to transmit force (e.g., rotation) from the motor 44 to the drum 18. For example, in the illustrated embodiment, the drive mechanism includes a shaft and a gear reduction that transmits rotational force of the motor 44 to the drum 18 to rotate the drum 18. This rotational force is then transmitted to the cable 22 to rotate the cable 22 within the drain.

The motor 44 is powered by a battery pack (not shown) that is at least partially housed in the battery receptacle 38. In some embodiments, the battery pack may be, for example, a rechargeable power tool battery pack, such as a 12V or 18V Li-ion battery pack. The battery receptacle 38 receives and supports the battery pack. The battery receptacle 38 includes terminals that electrically connect the battery pack to the motor 44. In other embodiments, the handle assembly 42 may support a power cord to electrically connect the motor 44 to an AC power source.

The handle assembly 42 extends rearwardly from the drum 18. The illustrated handle assembly 42 is disposed above the motor 44 compartment 34 and battery receptacle 38. The handle assembly 42 includes a grip that is configured to be grasped by a user for carrying and operating the drain cleaner 10. The handle assembly 42 supports a trigger adjacent the grip. The trigger is actuatable (e.g., depressible) by a user to selectively energize the motor 44 and, thereby, operate the drain cleaner 10. In other embodiments, the drain cleaner 10 may include other suitable actuators for selectively energizing the motor 44.

The stand 46 extends downwardly from the body 14, generally beneath the handle assembly 42. The stand 46 provides a relatively flat surface for the drain cleaner 10 to rest on in an upright position. The stand 46 allows the drain cleaner 10 to remain upright with or without a battery pack connected to the battery receptacle 38.

The second housing 30 extends forwardly of the drum 18. The drum 18 is rotatably supported between the first housing 26 and the second housing 30 to thereby drive rotation of the cable 22. The second housing 30 includes a pommel handle 50. The second housing 30 also supports a cable feed mechanism 54. The pommel handle 50 provides the user with additional control of the drain cleaner 10 during operation. The cable feed mechanism 54 drives linear movement of the cable 22 into and out of the drum 18. Accordingly, the rotation of the drum 18 drives rotation of the cable 22 to break up clogs inside the drain, while the cable feed mechanism 54 drives linear movement of the cable 22 into and out of the drain.

FIGS. 3-11 illustrate the cable feed mechanism 54 in more detail. As shown in FIGS. 3-6, the cable feed mechanism 54 includes a plurality of feed members 58, a drive gear 62, a collar 66, and a carrier 70. The feed members 58 are arranged concentrically around the cable 22 and are selectively engagable with the cable 22. The drive gear 62 surrounds the feed members 58 and moves the feed members 58 into and out of engagement with the cable 22. The collar 66 surrounds the drive gear 62 and is rotatably fixed relative to the drive gear 62. The collar 66 can be adjusted by a user to control the operation of the cable feed mechanism 54. The carrier 70 supports the feed members 58, the drive gear 62, and the collar 66, as well as other working components of the cable feed mechanism 54.

Figure 6:
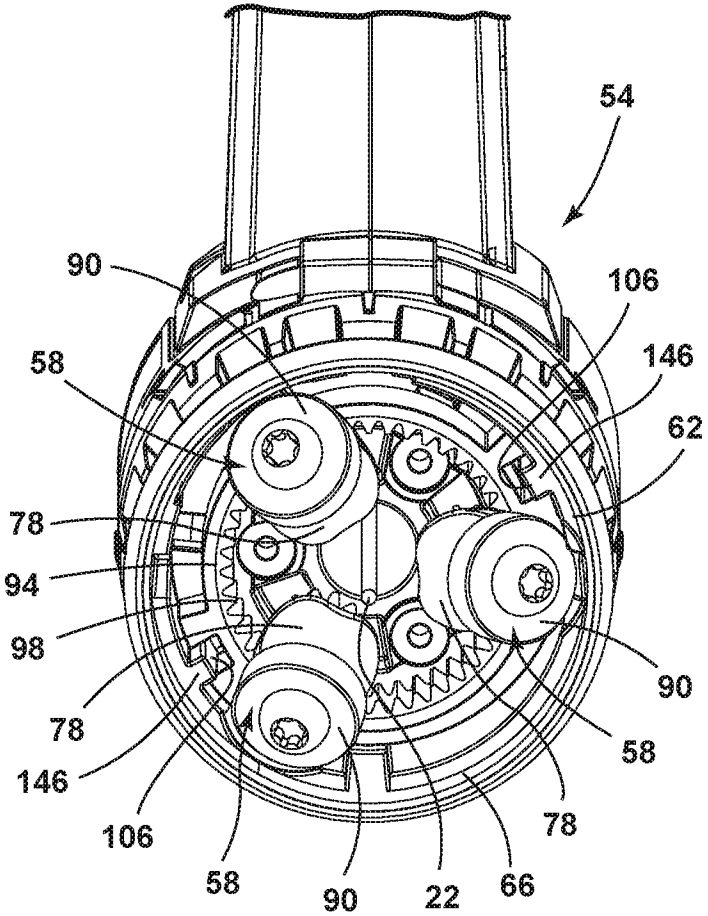
FIG. 6 a front plan view of the cable feed mechanism of FIG. 3.
Figure 7B:
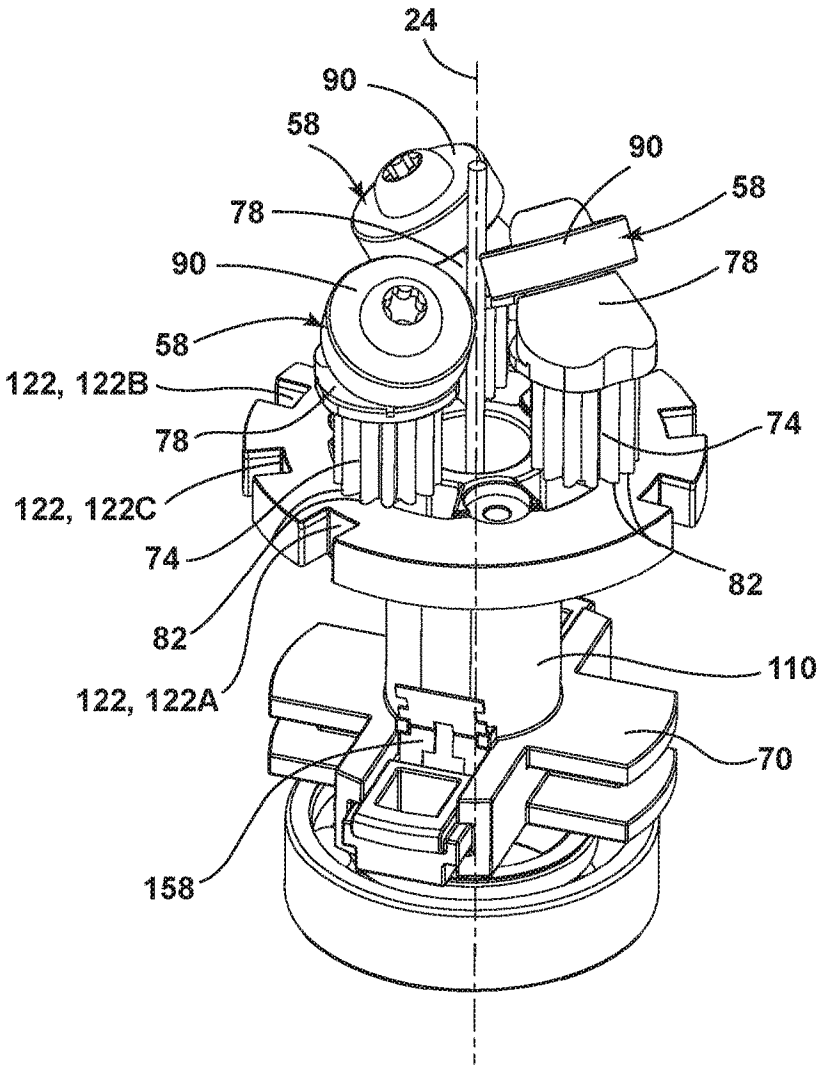
FIG. 7B is a perspective view of the cable feed mechanism of FIG. 3 with the collar and the drive gear removed, where the cable feed mechanism is in a forward feed position.

With reference to FIGS. 5-7B, the feed members 58 are arranged concentrically around the cable 22. FIGS. 7A and 7B illustrate the cable feed mechanism 54 with the drive gear 62 and the collar 66 removed to reveal the feed members 58. The feed members 58 are selectively engagable with the cable 22 to feed the cable 22 in a linear direction along the cable axis 24. Specifically, as the cable 22 is rotated by the motor 44, the feed members 58 frictionally engage the cable 22 to move the cable 22 in a linear direction. When the feed members 58 are aligned in the direction of the helical threads of the cable 22, the feed members 58 will feed the cable 22 forwardly out of the drum 18. When the feed members 58 are aligned against the direction of the helical threads of the cable 22, the feed members 58 will feed the cable 22 in reverse, into the drum 18.

Figure 4A:
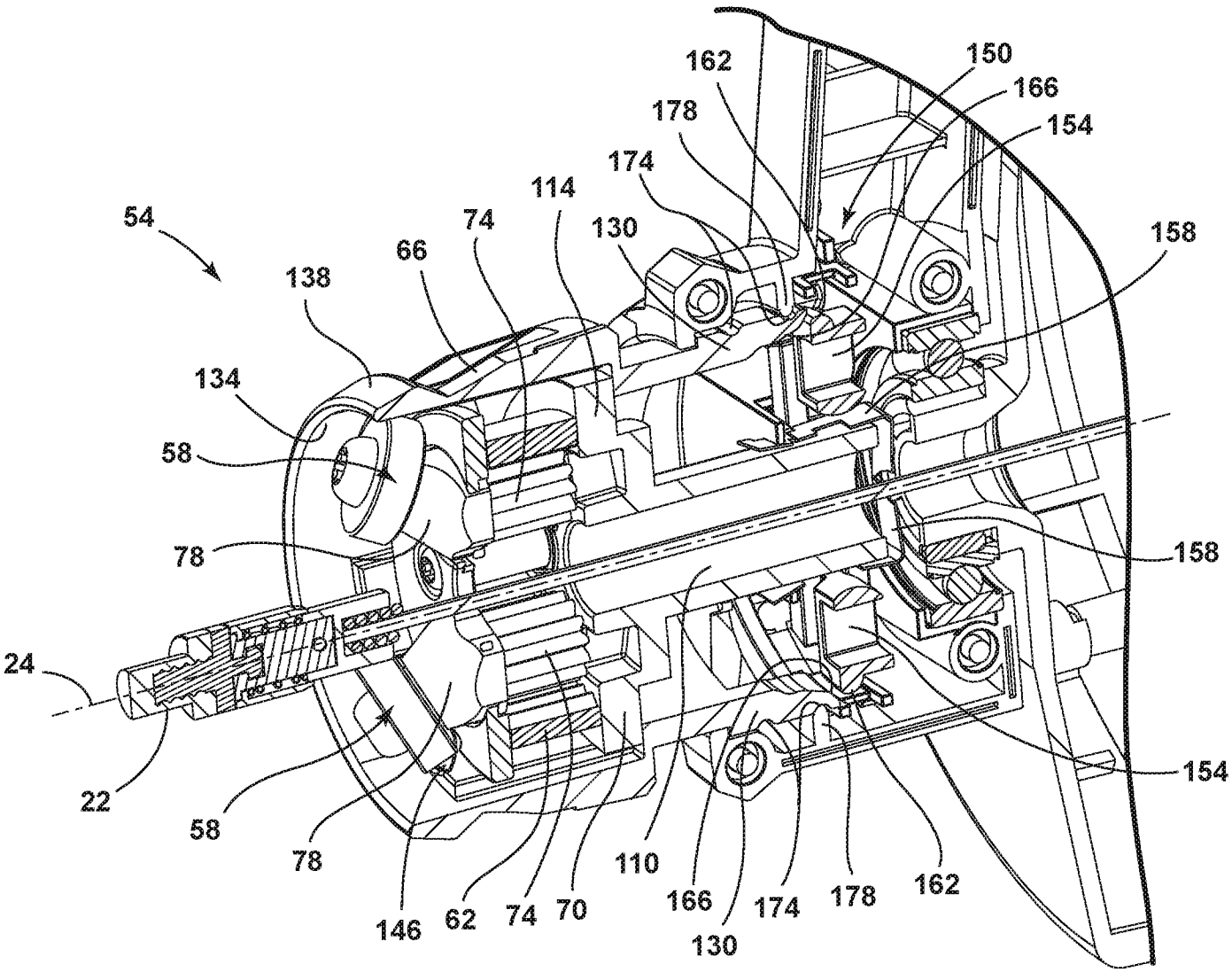
FIG. 4A is a cross-sectional view of the cable feed mechanism taken along section line IV-IV of FIG. 3, with the cable feed mechanism in a neutral and unlocked position.
Figure 4B:
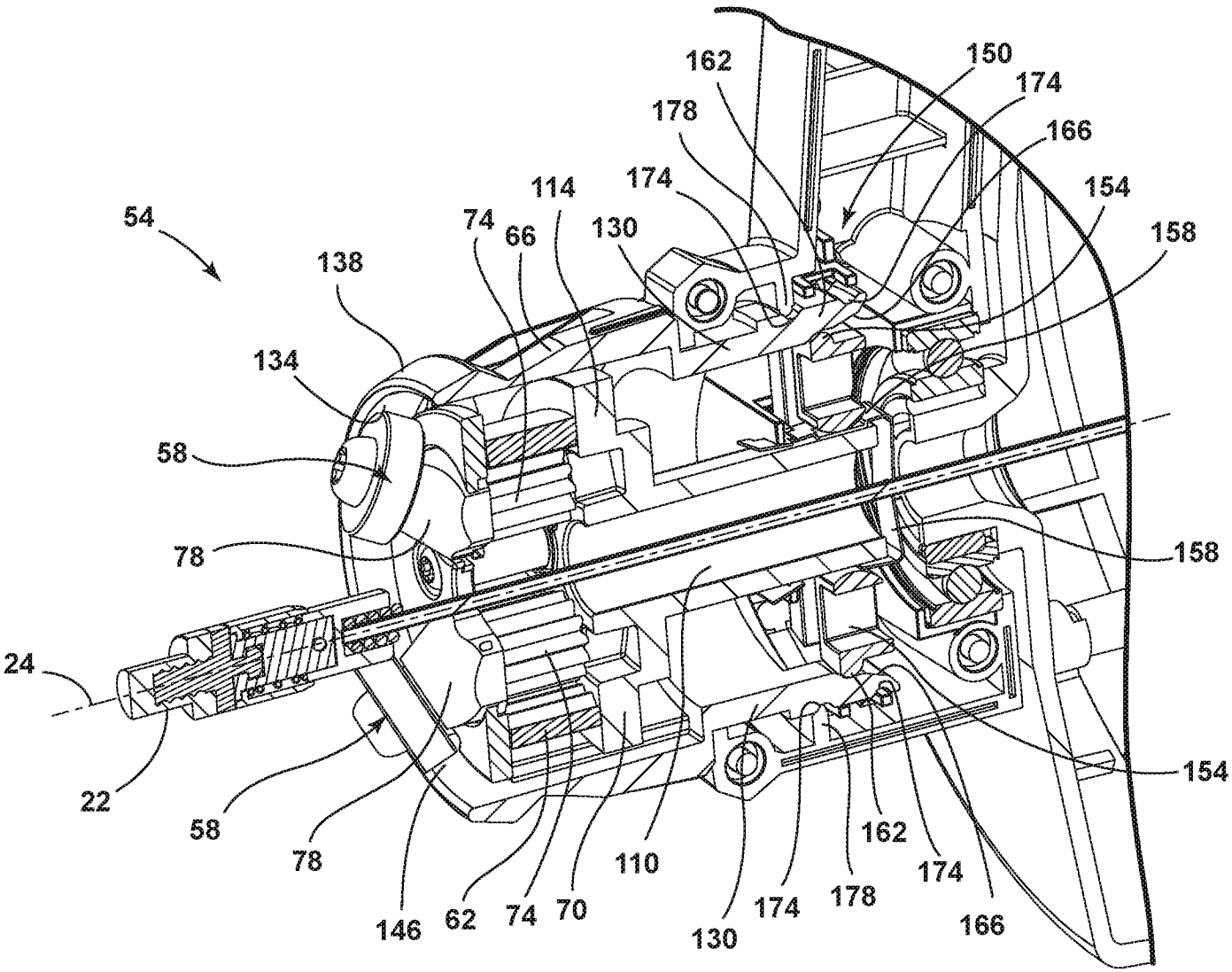
FIG. 4B is a cross-sectional view of the cable feed mechanism taken along section line IV-IV of FIG. 3, with the cable feed mechanism in a neutral and locked position.
Figure 4C:
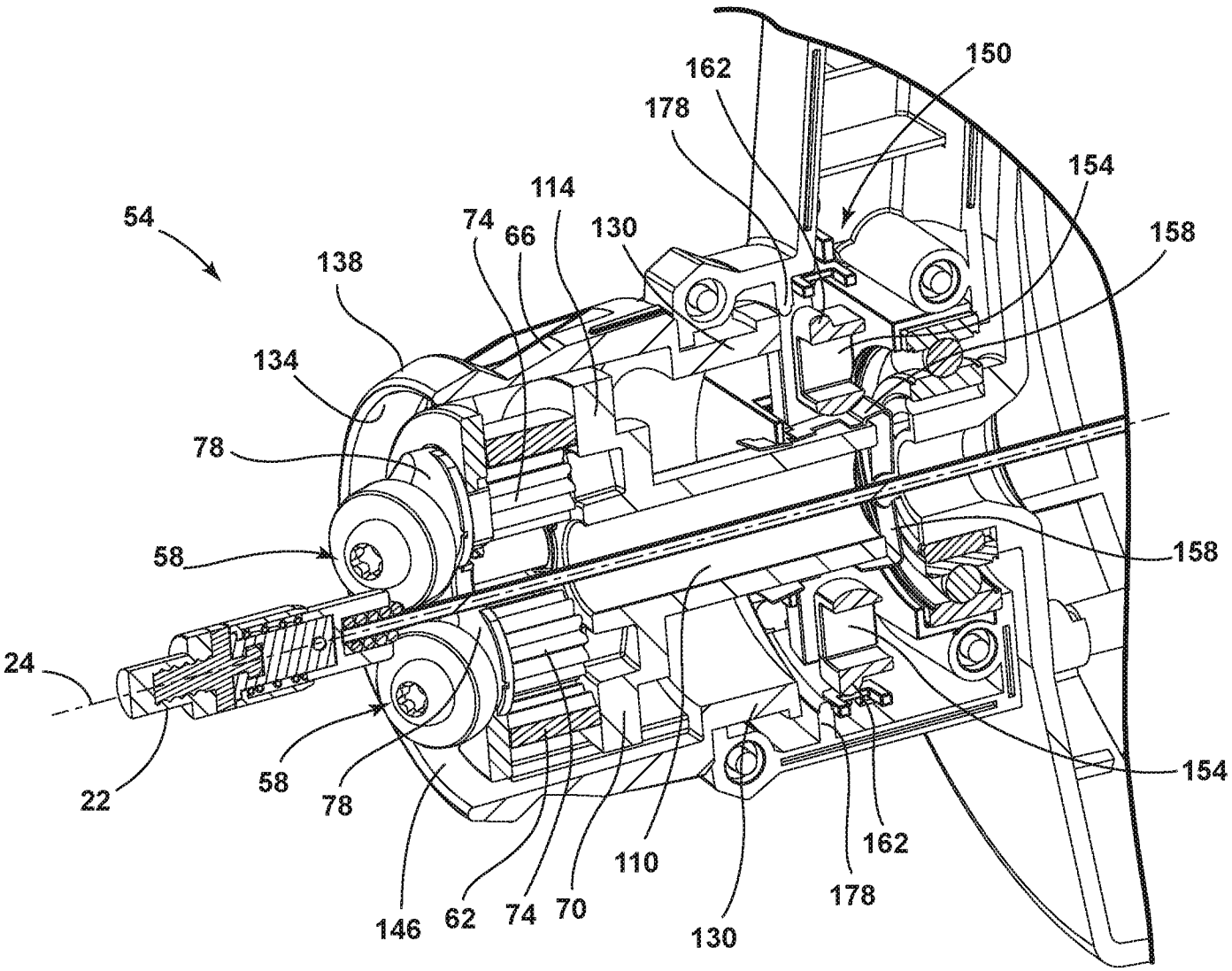
FIG. 4C is a cross-sectional view of the cable feed mechanism taken along section line IV-IV of FIG. 3, with the cable feed mechanism in a forward feed and locked position.
Figure 4D:
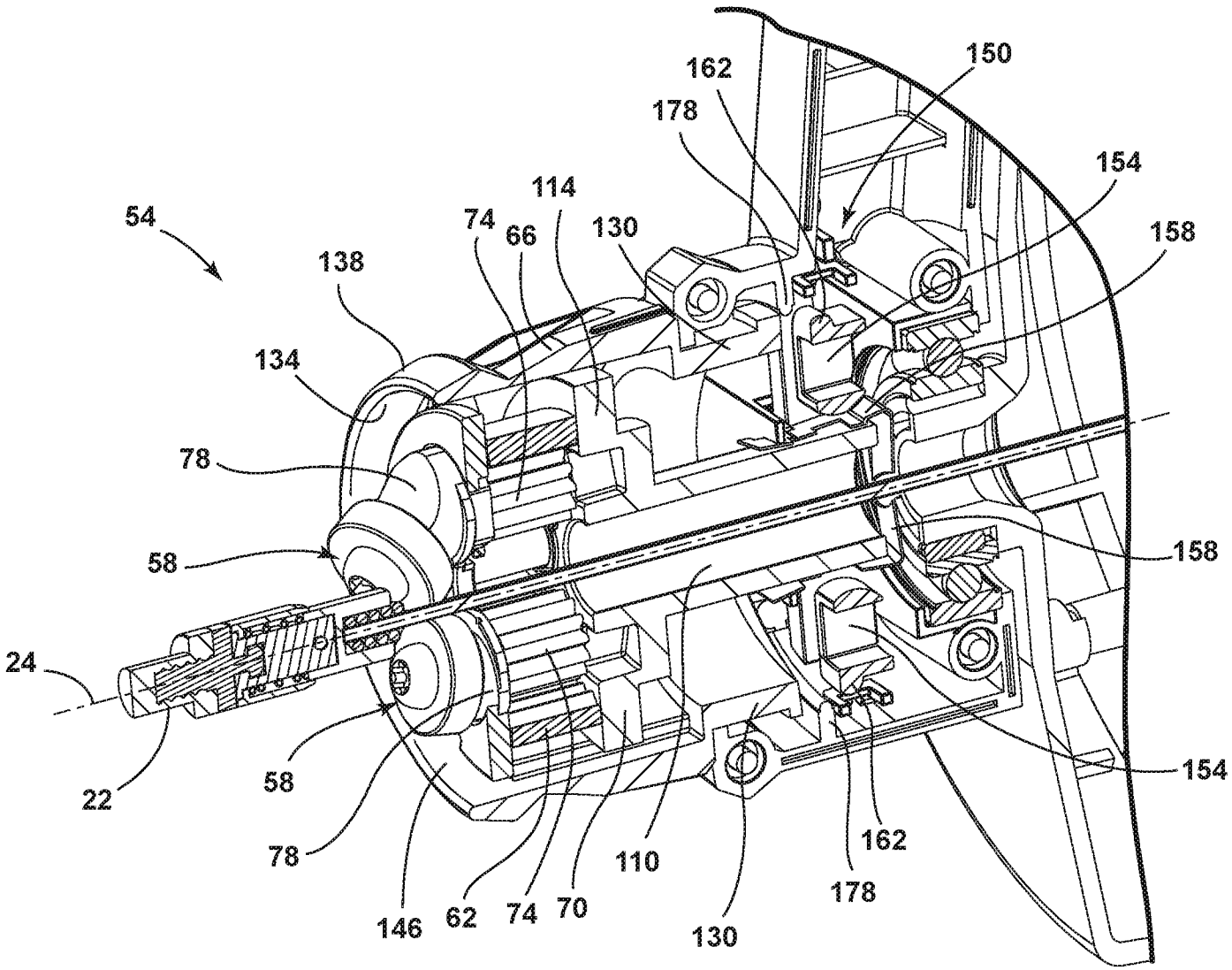
FIG. 4D is a cross-sectional view of the cable feed mechanism taken along section line IV-IV of FIG. 3, with the cable feed mechanism in a reverse feed and locked position.
Figure 9A:
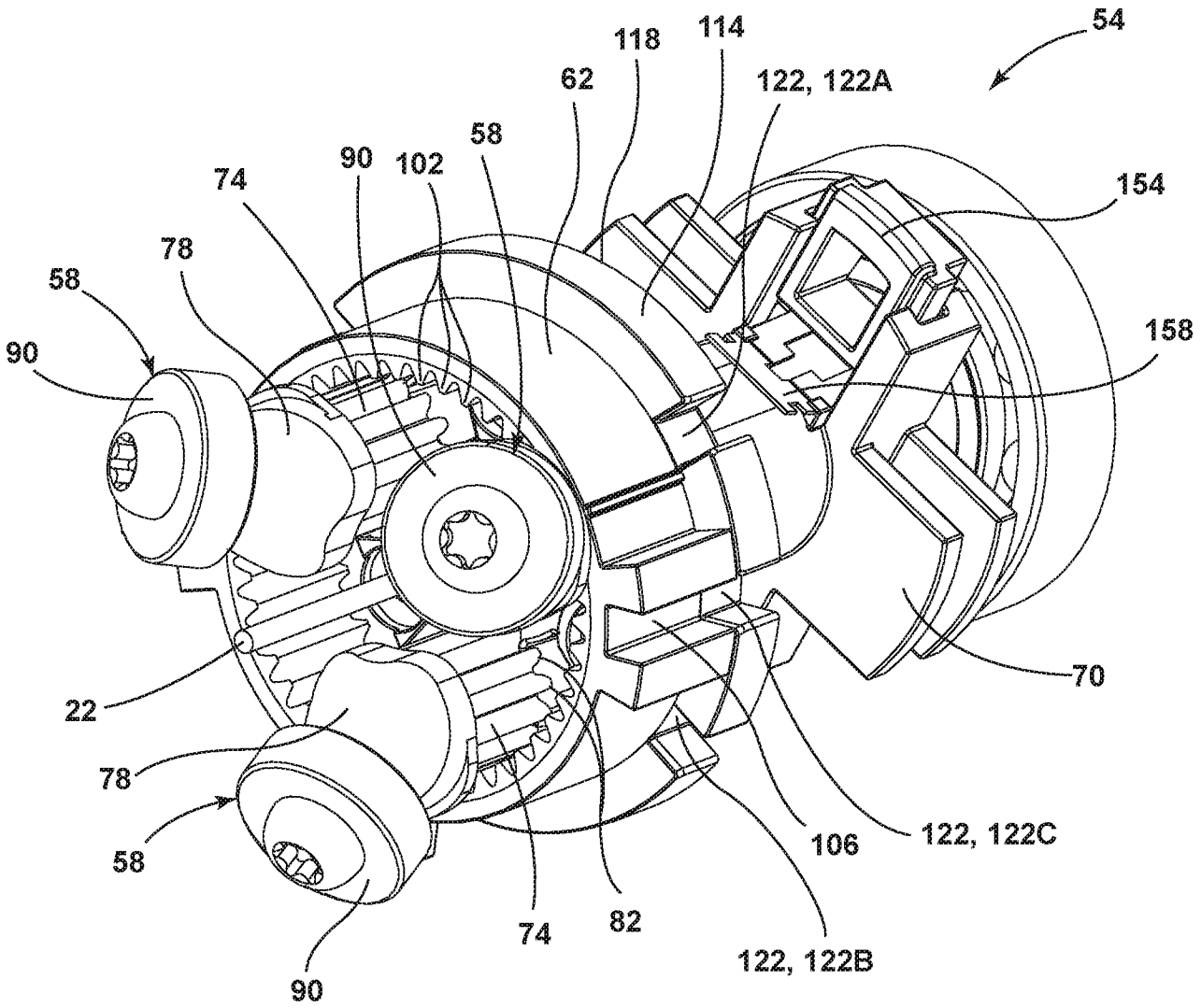
FIG. 9A is a perspective view of the cable feed mechanism of FIG. 3 with the collar removed, where the cable feed mechanism is in the neutral position.
Figure 9B:
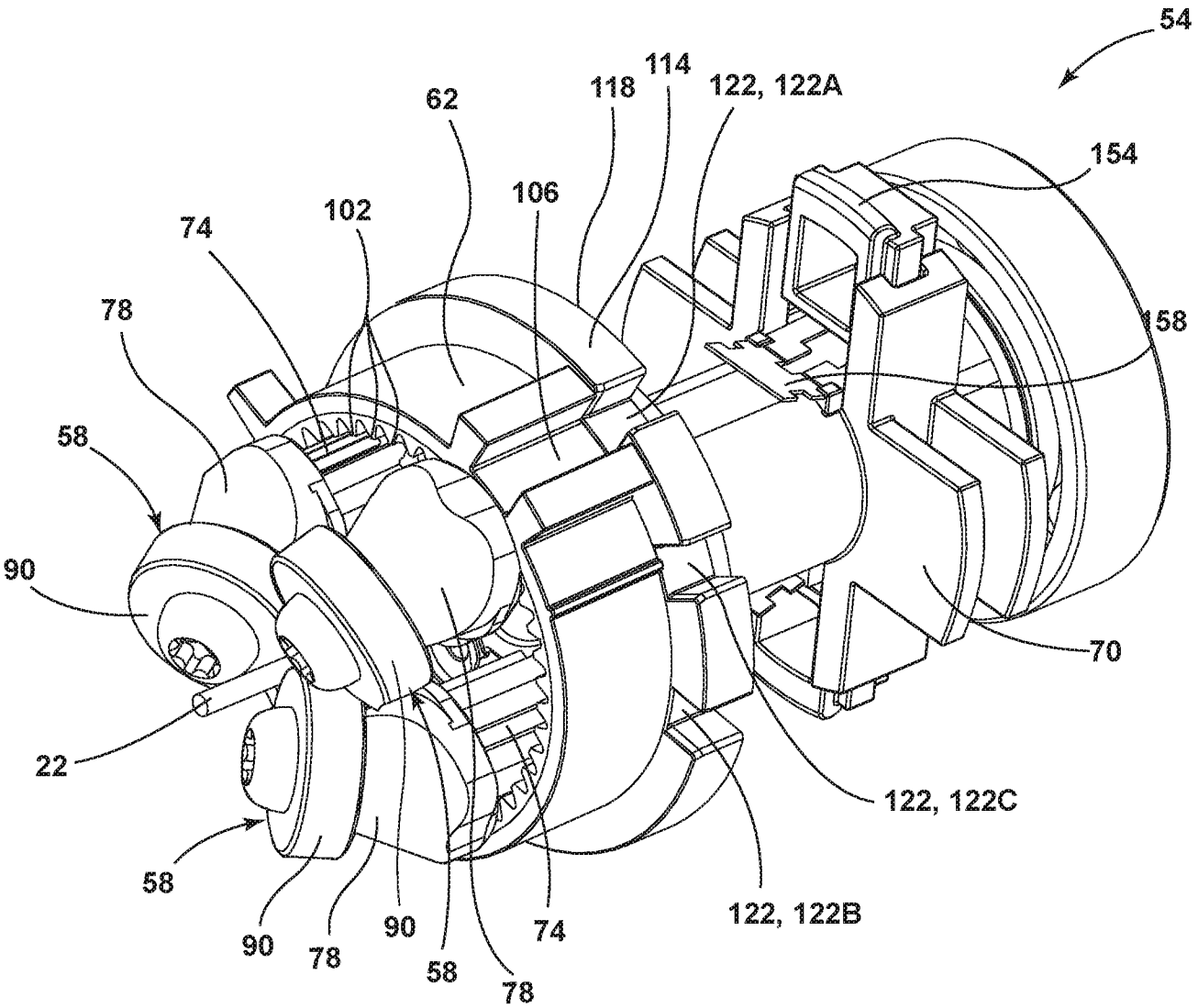
FIG. 9B is a perspective view of the cable feed mechanism of FIG. 3 with the collar removed, where the cable feed mechanism is in the forward feed position.
Figure 9C:
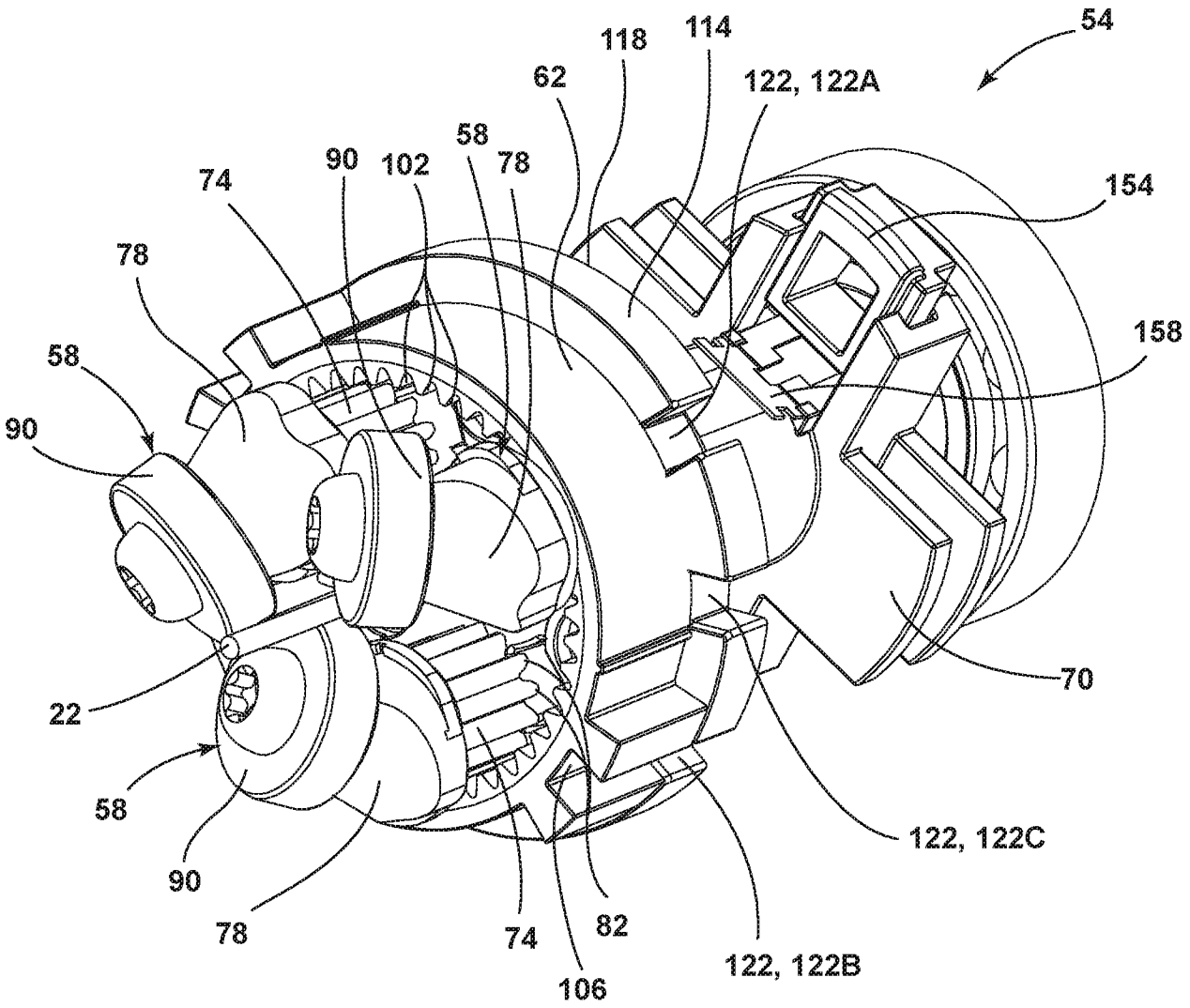
FIG. 9C is a perspective view of the cable feed mechanism of FIG. 3 with the collar removed, where the cable feed mechanism is in a reverse feed position.
Figure 10:
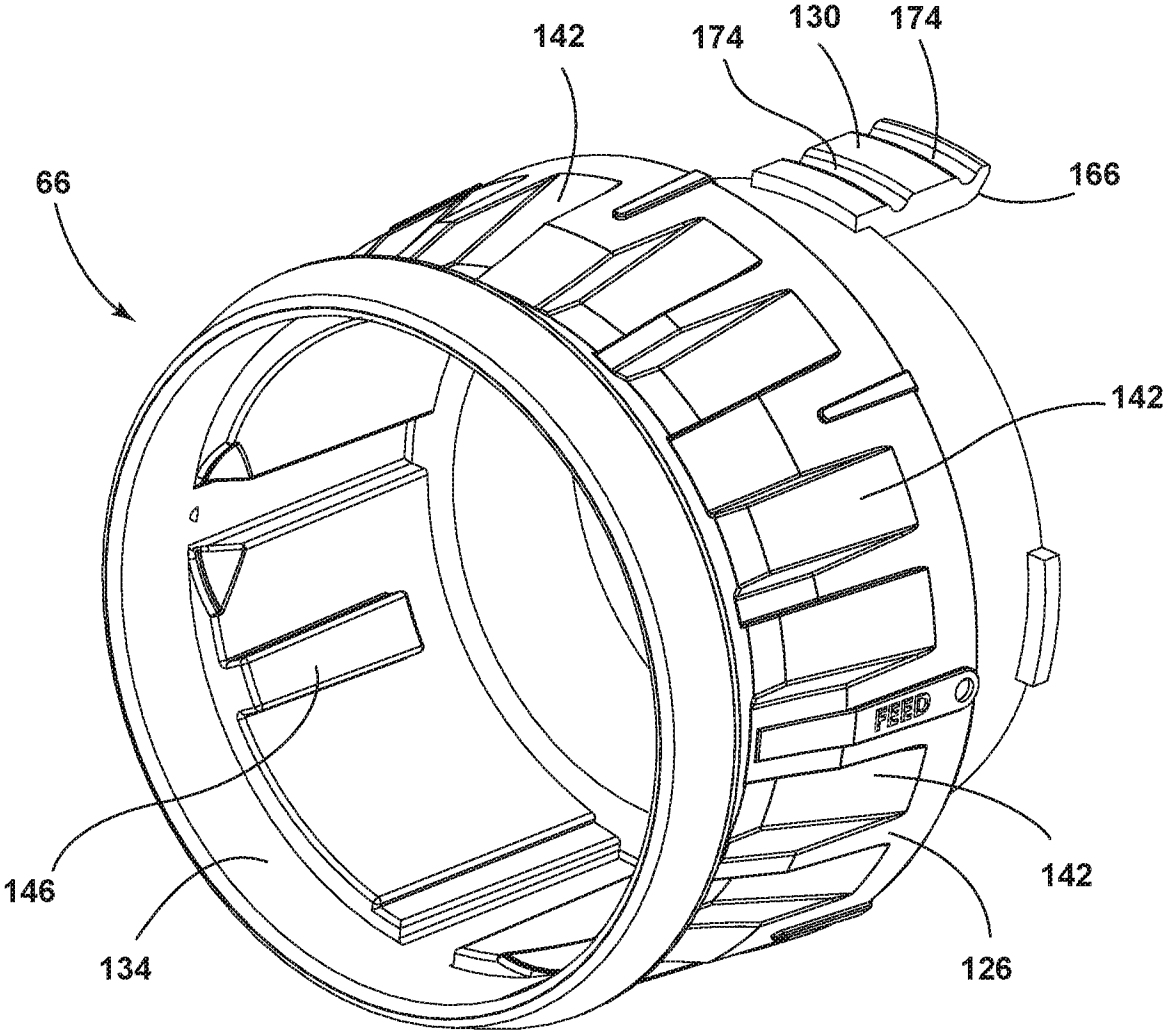
FIG. 10 is an enlarged perspective view of the collar.
Figure 11:
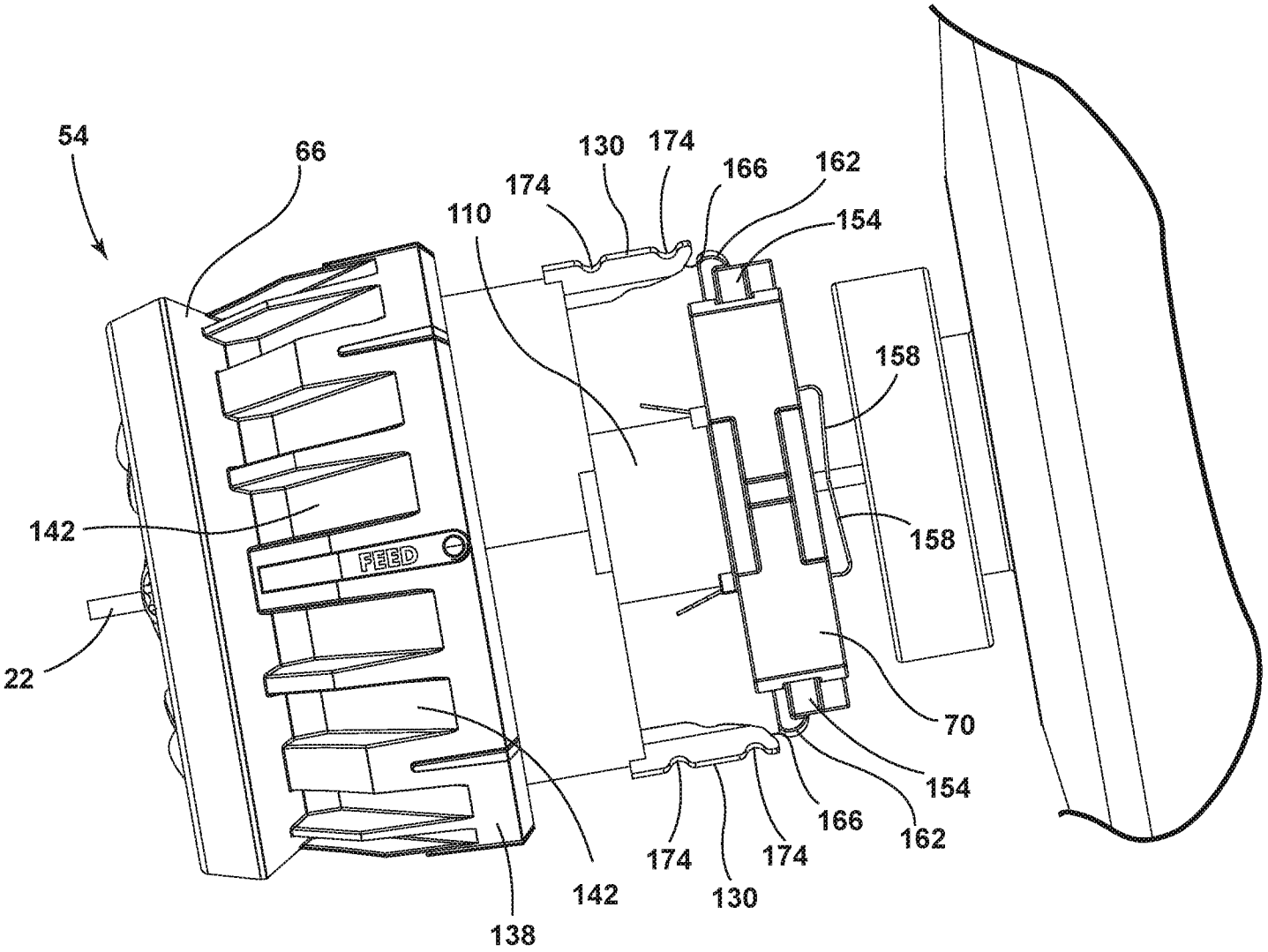
FIG. 11 is a side view of the cable feed mechanism of FIG. 3.

The feed members 58 are movable to multiple feed positions, including a neutral feed position (FIGS. 4A, 4B, and 9A), a forward feed position (FIGS. 4C and 9B), and a reverse feed position (FIGS. 4D and 9C). When the feed members 58 are in the forward feed position, the feed members 58 are engaged with the cable 22 and oriented at an angle to feed the cable 22 out of the drum 18 and into the drain. When the feed members 58 are in the reverse feed position, the feed members 58 are engaged with the cable 22 in an orientation that feeds the cable 22 back into the drum 18. When the feed members 58 are in the neutral feed position, the feed members 58 are disengaged from the cable 22 such that the cable 22 continues to rotate due to the rotation of the drum 18, but the cable 22 is not fed in a linear direction along the cable axis 24. In some embodiments, the feed members 58 may not be movable to all of these feed positions.

Figure 8B:
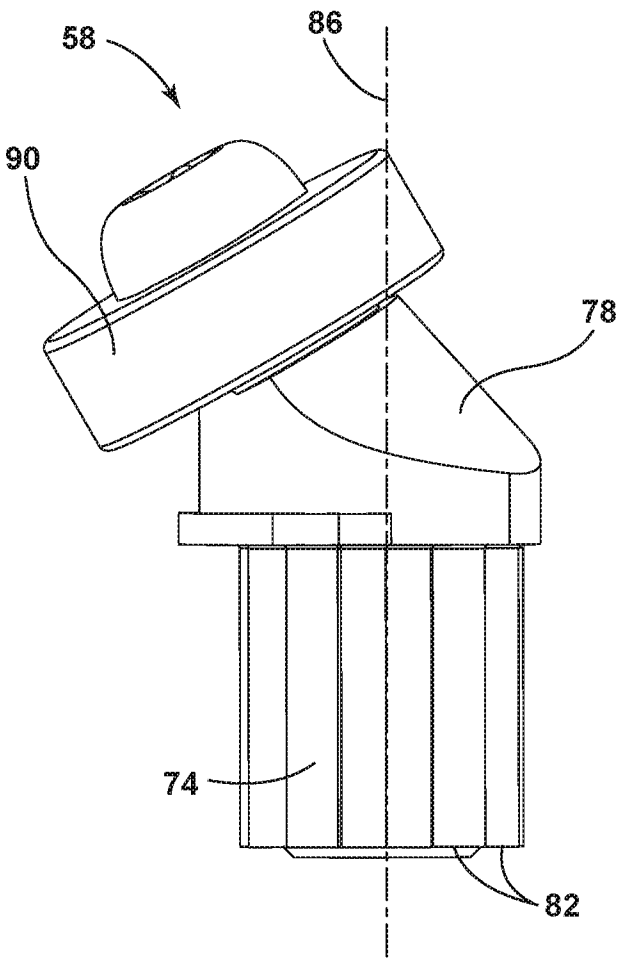
FIG. 8B is a second side view of the feed member of FIG. 8A.
Figure 8A:
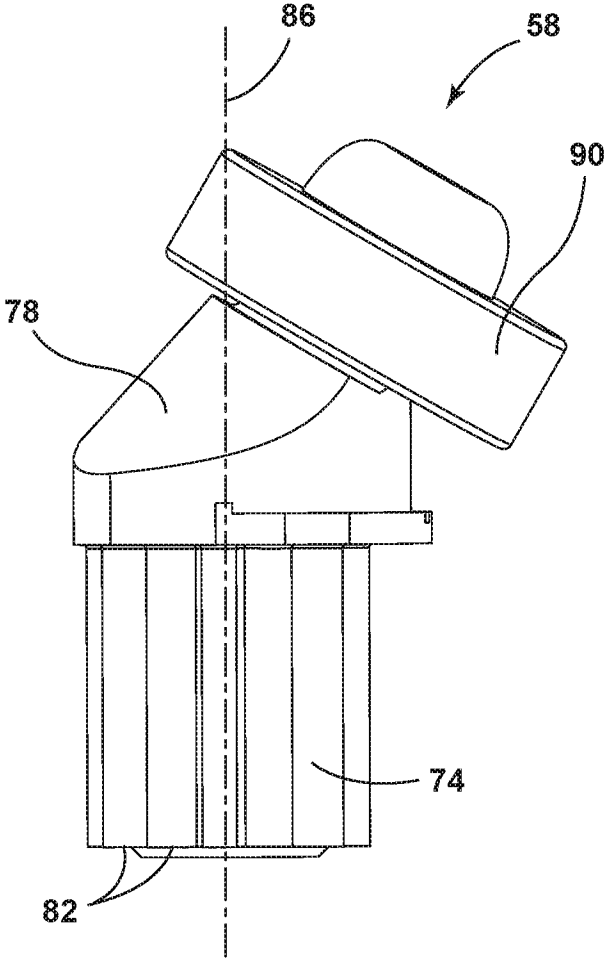
FIG. 8A is first side view of a feed member of the cable feed mechanism.

In the illustrated embodiment, the cable feed mechanism 54 includes three feed members 58. However, in other embodiments, the cable feed mechanism 54 may include a greater or fewer number of feed members 58. Each feed member 58 includes a driven gear 74 and a roller 78. Each driven gear 74 has a plurality of teeth 82 arranged around the perimeter of the driven gear 74. In the illustrated embodiment, the teeth 82 extend around the entire circumference of the driven gear 74; however, in other embodiments the teeth 82 may only be disposed along a portion of the driven gear 74. Each driven gear 74 is rotatable about an individual gear axis 86 (FIGS. 8A and 8B). The gear axes 86 are substantially parallel to the cable axis 24.

The rollers 78 of each feed member 58 are positioned adjacent the respective driven gear 74 along the respective gear axis 86. However, each roller 78 is oriented at an oblique angle relative to the respective gear axis 86. More specifically, the rollers 78 extend from the driven gears 74 at an off-axis angle. In the illustrated embodiment, the end of each roller 78 forms a disk 90 that can selectively engage the cable 22. In other embodiments, the rollers 78 can be different shapes and/or sizes.

Figure 7A:
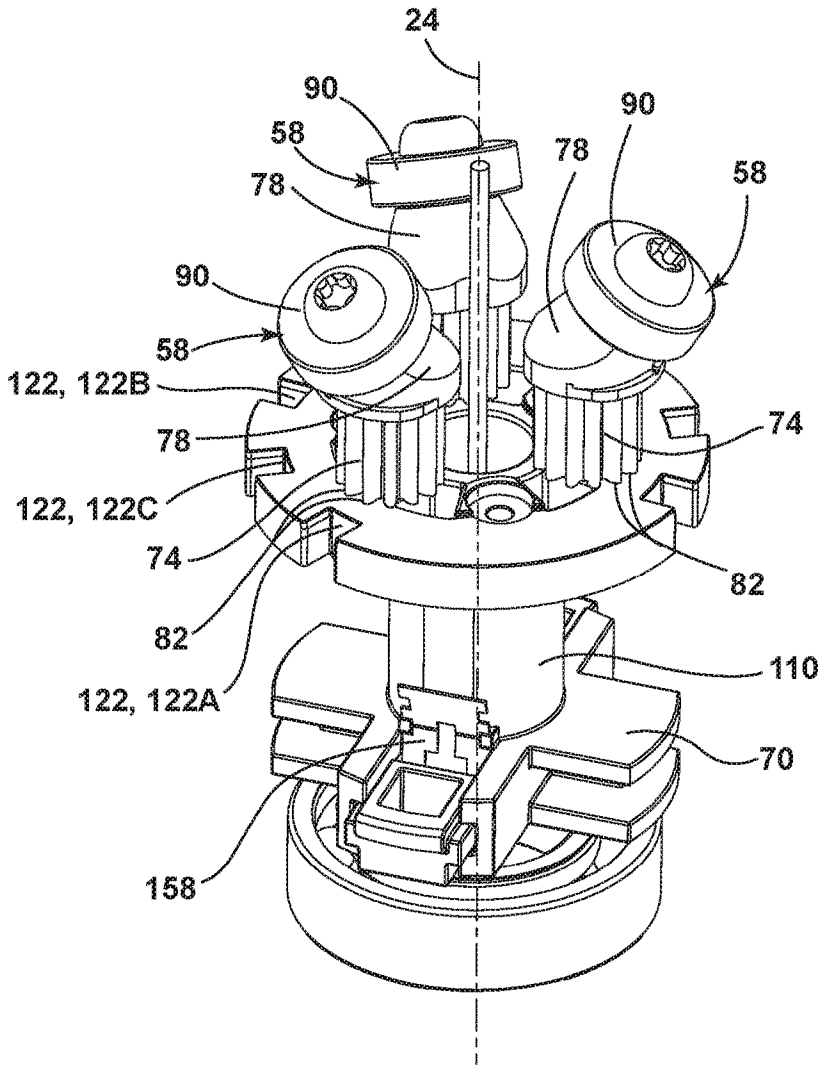
FIG. 7A is a perspective view of the cable feed mechanism of FIG. 3 with a collar and a drive gear removed, where the cable feed mechanism is in a neutral position.

The rollers 78 are rotatable about the respective gear axes 86 to the different feed positions. For example, when the rollers 78 are in the neutral position, as shown in FIG. 7A, the rollers 78 are angled away from the cable 22 such that the rollers 78 are disengaged from the cable 22. However, as shown in FIG. 7B, when the feed members 58 rotate about the gear axes 86, the rollers 78 will be angled towards the cable 22 and will be engaged with the cable 22. More specifically, because the rollers 78 are oriented off-axis, rotation of the feed members 58 moves the rollers 78 radially inward and into engagement with the cable 22. The rollers 78 can be rotated to engage the cable 22 at different orientations corresponding to the forward feed position and the reverse feed position. For example, the rollers 78 can be rotated in a first direction into the forward feed position.

When in the forward feed position, the disks 90 of the rollers 78 are oriented to engage the cable 22 at a first angle, which feeds the cable 22 forward out of the drum 18. FIG. 8A shows a single roller 78 with the disk 90 oriented at a first angle. Similarly, the rollers 78 can be rotated in a second direction into the reverse feed position. When the rollers 78 are in the reverse feed position, the disk 90 of the roller 78 is oriented to engage the cable 22 at a second angle, which feeds the cable 22 in the reverse direction back into the drum 18. FIG. 8B shows a single roller 78 with the disk 90 oriented at a second angle. The feed members 58 are biased towards the neutral position shown in FIG. 7A with the rollers 78 disengaged from the cable 22.

Figure 5:
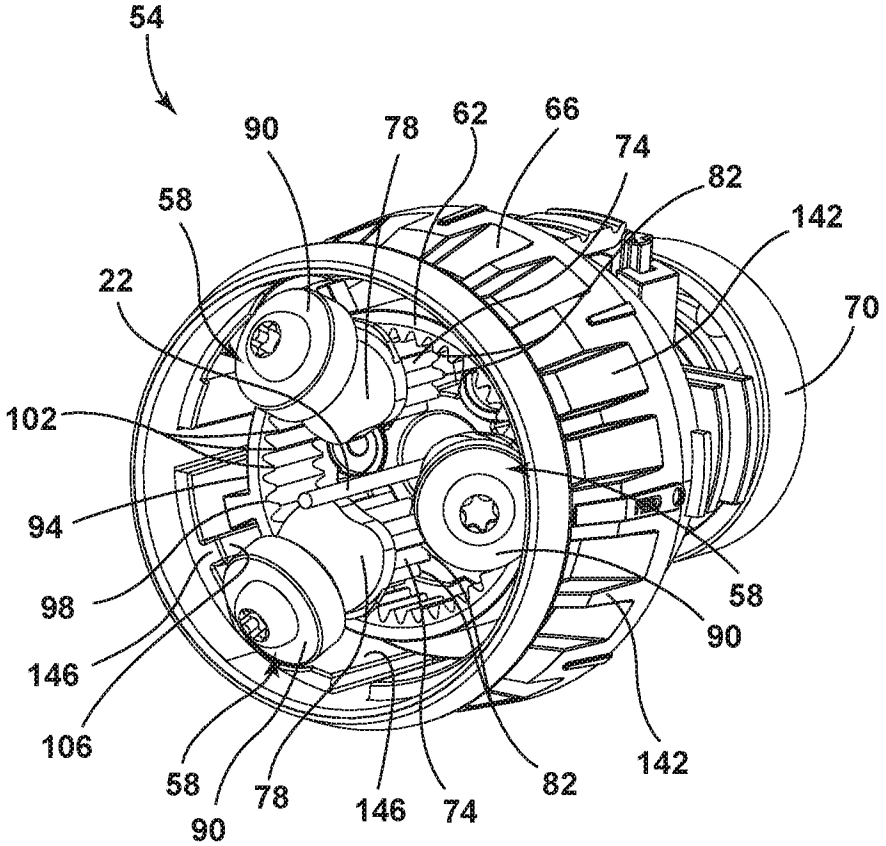
FIG. 5 a front perspective view of the cable feed mechanism of FIG. 3.

The feed members 58 are rotated to different feed positions by the drive gear 62. Referring to FIGS. 9A-9C, the drive gear 62 surrounds the feed members 58. In the illustrated embodiment, the drive gear 62 is a ring gear with an outer perimeter 94 and an inner perimeter 98 (FIGS. 5 and 6). The drive gear 62 includes a plurality of teeth 102 arranged along the inner perimeter 98. The teeth 102 of the drive gear 62 are in engagement with the teeth 82 of the driven gears 74. Rotation of the drive gear 62 rotates the driven gears 74 of the feed members 58 to move the rollers 78 into the different feed positions discussed above. As previously mentioned, the feed members 58 and the drive gear 62 are biased towards the neutral position.

In addition, the drive gear 62 includes two channels 106 on the outer perimeter 94. In the illustrated embodiment, the channels 106 are arranged on opposite sides of the drive gear 62. In other embodiments, the drive gear 62 may include fewer or more channels 106 on the outer perimeter 94, and the channels 106 may be arranged differently. The channels 106 are engaged by the collar 66 so that the collar 66 and the drive gear 62 rotate together about the cable axis 24. In other embodiments, the drive gear 62 may be another type of gear or may not surround the feed members 58.

The feed members 58 and the drive gear 62 are supported by the carrier 70. With reference to FIGS. 7A and 9A, the carrier 70 includes a hollow shaft 110 extending along the cable axis 24. Accordingly, the cable 22 extends through the hollow shaft 110 and rotates within the hollow shaft 110. The carrier 70 also includes a plate 114 positioned on one end of the hollow shaft 110 to support the feed members 58 and the drive gear 62. The feed members 58 and the drive gear 62 can rotate relative to the plate 114. Specifically, the feed members 58 rotate about their individual gear axes 86 and the drive gear 62 rotates about the cable axis 24. In the illustrated embodiment, the plate 114 is generally circular and includes a perimeter 118 that aligns with the outer perimeter 94 of the drive gear 62.

With reference to FIGS. 9A-9C, the perimeter 118 of the plate 114 includes a plurality of slots 122. In the illustrated embodiment, the plurality of slots 122 includes a forward slot 122A, a reverse slot 122B, and a neutral slot 122C. The drive gear 62 can rotate relative to the plate 114 such that the channel 106 of the drive gear 62 can align with the different slots 122 on the perimeter of the plate 114. FIG. 9A shows the channel 106 of the drive gear 62 aligned with the neutral slot 122C. In the illustrated embodiment, the drive gear 62 is biased towards the neutral position. When the drive gear 62 is rotated to align with the forward slot 122A (FIG. 9B), the cable feed mechanism 54 is in the forward feed position. When the drive gear 62 is rotated to align with the reverse slot 122B (FIG. 9C), the cable feed mechanism 54 is in the reverse feed position.

The drive gear 62 is rotated to the different feed positions by rotation of the collar 66. With reference to FIGS. 4A-6 and 10, the collar 66 has a cylindrical portion 126 and a pair of arms 130 extending axially from the cylindrical portion 126. The cylindrical portion 126 concentrically surrounds the drive gear 62 and the plate 114 of the carrier 70. The cylindrical portion 126 has an interior surface 134 and an exterior surface 138. The exterior surface 138 includes a plurality of gripping members 142 to provide grip for a user. On the interior surface 134, the collar 66 includes a pair of protrusions 146 that are sized and shaped to engage with the channels 106 on the drive gear 62 and the slots 122 on the plate 114 of the carrier 70. In particular, the protrusions 146 are continuously engaged with the channels 106 on the drive gear 62, but are selectively engagable with the slots 122 on the plate 114 of the carrier 70.

The protrusions 146 can slide in an axial direction within the channels 106 of the drive gear 62. In addition, the protrusions 146 are elongated, such that when the collar 66 is moved axially relative to the drive gear 62, a portion of the protrusion 146 continues to remain engaged with the channels 106. This allows the collar 66 to move in a linear direction relative to the drive gear 62 while remaining rotatably fixed relative to the drive gear 62. In other words, the collar 66 and the drive gear 62 rotate about the cable axis 24 as a single unit. However, the collar 66 can slide linearly, along the cable axis 24, while the drive gear 62 remains stationary. Nevertheless, the protrusions 146 of the collar 66 remain continuously engaged with the channels 106 of the drive gear 62.

The protrusions 146 are selectively engagable with the slots 122 on the carrier 70 when the collar 66 is slid axially.

Moving the collar 66 axially into the forward slot 122A or the reverse slot 122B maintains the collar 66, and thereby drive gear 62 and the feed members 58, in the forward feed position or the reverse feed position, respectively. Moving the collar 66 axially into the neutral slot 122C "locks" the cable 22 to inhibit the cable 22 from moving axially in either direction. More specifically, the collar 66 is maintained in an axial position within the slots 122 of the carrier 70 by recesses 174 on the arms 130 that engage with protrusions 178 (FIGS. 4A and 4B) on the housing 30. As shown in FIG. 4A, when the collar 66 is slid away from the housing 30 (to the left in the drawing), the protrusions 178 engage the recesses 174 further from the cylindrical portion 126. In this position, the protrusions 146 of the collar 66 are maintained within the channels 106 of the drive gear 62, but out of the slots 122 of the carrier 70. As shown in FIG. 4B, when the collar 66 is slid toward the housing 30 (to the right in the drawing), the protrusions 178 engage the recesses 174 closer to the cylindrical portion 126. In this position, the protrusions 146 of the collar 66 are maintained within the channels 106 of the drive gear 62 and within the slots 22 of the carrier 70. The protrusions 146 and the recesses 174 thereby act as detent-type mechanisms to releasably hold the collar 66 and inhibit the collar 66 from freely sliding between axial positions. In other embodiments, the arms 130 may include the protrusions 178 while the housing 30 incudes the recesses 174. The recesses 174 and protrusions 178 can be used to maintain the collar 66 in any of the feed positions (e.g., forward feed, reverse feed, or neutral feed positions). FIG. 4A shows the cable feed mechanism 54 in the neutral and unlocked position, whereas FIG. 4B shows the cable feed mechanism 54 in the neutral and locked position. Similarly, FIG. 4C shows the cable feed mechanism 54 in the forward feed and locked position and FIG. 4D shows the cable feed mechanism 54 in the reverse feed and locked position.

As shown in FIGS. 3-4B and 11, the collar 66 is selectively engagable with a locking assembly 150 to lock the cable 22 in place. The locking assembly 150 clamps onto the cable 22 to prohibit linear movement of the cable 22 along the cable axis 24. For example, when the end of the cable 22 becomes entangled with a clog in the drain, a user can pull on the drain cleaner 10 to attempt to dislodge the clog without the cable 22 unraveling and being pulled out of the drum 18. Sliding the collar 66 axially to move the protrusion 146 into engagement with the neutral slot 122C "locks" the cable 22 in a stationary position. As the collar 66 is slid axially, the arms 130 of the collar 66 engage the locking assembly 150 and move the locking assembly 150 into engagement with the cable 22 to lock the cable 22 in a fixed axially position. When the collar 66 is rotated so the protrusions 146 are aligned with the forward slot 122A or the reverse slot 122B, the arms 130 are unaligned with the locking assembly 150 so axially sliding the collar 66 does not cause the arms 130 to engage the locking assembly 150.

Referring back to FIG. 4A, the locking assembly 150 includes two cam members 154 and two clamping members 158. In the illustrated embodiment, the cam member 154 is a block with a cam surface 162 that is configured to engage with a cam surface 166 on the arm 130 of the collar 66. The clamping member 158 is a leaf spring that is selectively engagable with the cable 22 to lock the cable 22 in place. In other embodiments, the cam member 154 and the clamping member 158 are formed as a single unit. As shown in FIG. 4B, when the collar 66 is moved axially into the neutral slot 122C (i.e., when the protrusion 146 is engaged with the neutral slot 122C), the cam surface 166 on the arm 130 of the collar 66 engages with the cam member 154 to push the cam member 154 radially inward. The cam member 154, in turn, pushes the clamping member 158 radially inward and into locking engagement with the cable 22. While in this position, the cable 22 is inhibited from moving axially into or out of the drum 18.

In operation, the motor 44 drives rotation of the drum 18, which rotates the cable 22 about the cable axis 24. Because the cable feed mechanism 54 is biased towards the neutral position, the feed members 58 are disengaged from the cable 22 when no outside force is exerted on the cable feed mechanism 54. As such, the cable 22 will continue to rotate about the cable axis 24, but will not move linearly along the cable axis 24. A user can adjust the cable feed mechanism 54 to feed the cable 22 linearly along the cable axis 24. Specifically, a user can rotate the collar 66 to drive the cable 22 into or out of the drum 18. Rotation of the collar 66 rotates the drive gear 62, which in turn, rotates the feed members 58 to the different feed positions. The collar 66 can be rotated in a first direction to move the feed members 58 into the forward feed position in order to feed the cable 22 out of the drum 18 and into the drain. The collar 66 can also be rotated in a second direction to move the feed members 58 into the reverse feed position in order to feed the cable 22 into the drum 18 and out of the drain.

Because the cable feed mechanism 54 is biased towards the neutral position, the user continues to hold the collar 66 in the rotated position (i.e., the forward feed position and the reverse feed position) in order to keep feeding the cable 22 linearly along the cable axis 24. When the collar 66 is released from one of the rotated positions the cable feed mechanism 54 is biased back towards the neutral position and the rollers 78 are disengaged from the cable 22.

To maintain the collar 66, and thereby the drive gear 62 and the feed members 58, in one of the rotated positions, the collar 66 is slid axially into engagement with one of the slots 122 on the plate 114 of the carrier 70. Specifically, the collar 66 is rotated about the cable axis 24 to align with the desired slot 122 and then slid linearly along the cable axis 24 to engage with the desired slot 122. For example, the collar 66 can be rotated in a first direction (e.g., clockwise) to align the protrusion 146 with the forward slot 122A. Moving the collar 66 axially so the protrusion 146 of the collar 66 engages with the forward slot 122A of the carrier 70 maintains the collar 66 in the forward feed position. Moving the collar 66 axially also moves the protrusions 178 on the housing 30 into engagement with the recesses 174 on the arms 130 closer to the cylindrical portion 126 so that the collar 66 is releasably held in engagement with the forward slot 122A.

The collar 66 can also be rotated in a second direction (e.g., counter-clockwise) to align the protrusion 146 with the reverse slot 122B. Moving the collar 66 axially so the protrusion 146 of the collar 66 engages with the reverse slot 122B of the carrier 70 maintains the collar 66 in the reverse feed position. Moving the collar 66 axially also moves the protrusions 178 on the housing 30 into engagement with the recesses 174 on the arms 130 closer to the cylindrical portion 126 so that the collar 66 is releasably held in engagement with the reverse slot 122B.

When the collar 66 is in the neutral position, the protrusion 146 and the neutral slot 122C are aligned. Sliding the collar 66 into engagement with the neutral slot 122C locks the cable 22 and prohibits the cable 22 from moving axially in either direction. Moving the collar 66 axially also moves the protrusions 178 on the housing 30 into engagement with the recesses 174 on the arms 130 closer to the cylindrical portion 126 so that the collar 66 is releasably held in engagement with the neutral slot 122C.

Accordingly, the invention provides a feed control mechanism that allows a user to control the linear movement of the cable 22 in a variety of different ways. The user can feed the cable 22 forwards or in reverse. The user can also manually maintain the feeding direction by holding the collar 66 in a rotated position, or can slide the collar 66 into one of the slots 122 so that the cable 22 is automatically maintained in a certain feeding direction. In addition, the user can lock the cable 22 in place to inhibit any linear movement of the cable 22.

The embodiment described above and illustrated in the figures are presented by way of example only and are not intended as a limitation upon the concepts and principles of the present invention. As such, it will be appreciated that various changes in the elements and their configuration and arrangement are possible without departing from the spirit and scope of the present invention. Various features and advantages of the invention are set forth in the following claims.

What is claimed is:

1. A drain cleaner, comprising:

a rotatable drum;

a cable including a first portion housed within the drum and a second portion extending outwardly from the drum along a cable axis, the cable rotatable about the cable axis; and a cable feed mechanism for feeding the cable out of the rotatable drum in an axial direction along the cable axis, the cable feed mechanism including a plurality of feed members selectively engagable with the cable, and a drive gear surrounding the plurality of feed members, the drive gear being engaged with the plurality of feed members, wherein rotation of the drive gear moves the plurality of feed members into engagement with the cable.

2. The drain cleaner of claim 1, wherein rotation of the drive gear in a first direction moves the plurality of feed members into engagement with the cable in a forward feed orientation.

3. The drain cleaner of claim 2, wherein rotation of the drive gear in a second direction that is opposite the first direction moves the plurality of feed members into engagement with the cable in a reverse feed orientation.

4. The drain cleaner of claim 1, wherein the drive gear is biased towards a neutral feed position in which the plurality of feed members is disengaged from the cable.

5. The drain cleaner of claim 1, wherein each feed member includes a driven gear and a roller, wherein each driven gear rotates about an axis that is parallel to the cable axis, and wherein each roller is oriented at an oblique angle relative to the axis of the corresponding driven gear.

6. The drain cleaner of claim 1, further comprising a collar, the collar extending concentrically around the drive gear, the collar being rotatably fixed relative to the drive gear and linearly movable relative to the drive gear.

7. The drain cleaner of claim 6, wherein the collar is axially movable between a locked position and an unlocked position.

8. The drain cleaner of claim 7, wherein the cable feed mechanism further includes a carrier having a plurality of slots including at least one selected from the group consisting of a forward slot, a reverse slot, and a neutral slot, and wherein rotation of the collar rotates a channel on the drive gear into alignment with one of the plurality of slots on the carrier.

9. The drain cleaner of claim 8, wherein the collar includes a protrusion configured to selectively engage one of the plurality of slots when the collar is moved linearly relative to the drive gear, and wherein engagement of the forward slot by the collar maintains the plurality of feed members in a forward feed orientation, and wherein engagement of the reverse slot by the collar maintains the plurality of feed members in a reverse feed orientation.

10. The drain cleaner of claim 6, further comprising a housing supporting the rotatable drum and the cable feed mechanism, the housing having a protrusion that is engagable with a recess on the collar.

11. The drain cleaner of claim 8, wherein engagement of the neutral slot by the collar locks the cable in a fixed position to prohibit movement of the cable along the cable axis.

12. The drain cleaner of claim 11, further comprising a locking assembly selectively engagable with the cable to prohibit movement of the cable along the cable axis, the locking assembly movable in a radial direction to selectively engage the cable, wherein the collar includes an arm extending in the axial direction, and wherein linear movement of the collar in the axial direction causes the arm to contact the locking assembly and thereby move the locking assembly radially inward and into engagement with the cable.

13. A drain cleaner, comprising:

a rotatable drum;

a cable including a first portion housed within the drum and a second portion extending outwardly of the drum along a cable axis, the cable rotatable about the cable axis; and a cable feed mechanism for feeding the cable in an axial direction along the cable axis in a feed direction, the cable feed mechanism including a plurality of feed members selectively engagable with the cable, wherein engagement of the plurality of feed members with the cable feeds the cable along the cable axis, a drive gear concentrically surrounding the plurality of feed members, and a collar concentrically surrounding the drive gear, the collar rotatably fixed relative to the drive gear to change the feed direction by rotation of the drive gear and linearly movable relative to the drive gear to lock and unlock the drive gear from further rotation, wherein rotation of the collar moves the plurality of feed members into engagement with the cable.

14. The drain cleaner of claim 13, wherein rotation of the collar in a first direction moves the plurality of feed members into engagement with the cable in a forward feed orientation.

15. The drain cleaner of claim 14, wherein rotation of the collar in a second direction moves the plurality of feed members into engagement with the cable in a reverse feed orientation, the second direction being different from the first direction.

16. The drain cleaner of claim 13, wherein the collar is biased towards a neutral feed position in which the plurality of feed members is disengaged from the cable.

17. The drain cleaner of claim 13, wherein the cable feed mechanism further includes a carrier positioned adjacent the drive gear, the carrier including a plurality of slots, wherein the plurality of slots includes at least one selected from the group consisting of a forward slot, a reverse slot, and a neutral slot, and wherein the collar includes a protrusion configured to selectively engage one of the plurality of slots when the collar is moved linearly relative to the drive gear.

18. The drain cleaner of claim 17, wherein engagement of the forward slot by the collar maintains the plurality of feed members in a forward feed orientation, and wherein engagement of the reverse slot by the collar maintains the plurality of feed members in a reverse feed orientation.

19. The drain cleaner of claim 17, wherein engagement of the neutral slot by the collar locks the cable in a fixed position to prohibit movement of the cable along the cable axis.

20. A drain cleaner, comprising:

a rotatable drum;

a cable including a first portion housed within the drum and a second portion extending outwardly of the drum along a cable axis, the cable rotatable about the cable axis;

a plurality of feed members selectively engagable with the cable to feed the cable along the cable axis;

a drive gear surrounding the plurality of feed members, the drive gear engaged with the plurality of feed members, wherein rotation of the drive gear rotates the plurality of feed members and moves the plurality of feed members into engagement with the cable;

a collar extending concentrically around the drive gear, the collar rotatably fixed relative to the drive gear and linearly movable relative to the drive gear, the collar including a protrusion; and a carrier supporting the plurality of feed members and the drive gear, the carrier including a plurality of slots, wherein linear movement of the collar relative to the carrier selectively moves the protrusion into engagement with one of the plurality of slots.

* * * * *